US007182584B2

(12) United States Patent
Du et al.

(10) Patent No.: US 7,182,584 B2
(45) Date of Patent: Feb. 27, 2007

(54) MOTOR PROTECTOR

(75) Inventors: Michael Hui Du, Pearland, TX (US); Arthur I. Watson, Sugar Land, TX (US); Arunkumar Arumugam, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 317 days.

(21) Appl. No.: 10/708,470

(22) Filed: Mar. 5, 2004

(65) Prior Publication Data

US 2005/0087343 A1 Apr. 28, 2005

Related U.S. Application Data

(60) Provisional application No. 60/503,785, filed on Sep. 17, 2003.

(51) Int. Cl.
*F04B 17/00* (2006.01)

(52) U.S. Cl. ..... 417/414

(58) Field of Classification Search ..... 417/414, 417/423.3

See application file for complete search history.

(56) References Cited

U.S. PATENT DOCUMENTS

| | | | | |
|---|---|---|---|---|
| 4,477,235 | A * | 10/1984 | Gilmer et al. | 417/414 |
| 5,367,214 | A * | 11/1994 | Turner, Jr. | 310/87 |
| 5,699,859 | A * | 12/1997 | Poirier | 166/112 |
| 5,842,520 | A | 12/1998 | Bolin | |
| 6,595,280 | B2 * | 7/2003 | Traylor | 166/105.5 |
| 6,666,664 | B2 | 12/2003 | Gross | |
| 2002/0192090 | A1 * | 12/2002 | Du et al. | 417/423.11 |
| 2003/0132003 | A1 | 7/2003 | Arauz et al. | |
| 2005/0087343 | A1 | 4/2005 | Du et al. | |

FOREIGN PATENT DOCUMENTS

| | | | |
|---|---|---|---|
| GB | 2336946 | A | 11/1999 |
| GB | 2356414 | A | 5/2001 |
| GB | 2379094 | A | 2/2003 |
| RU | 2099604 | C1 | 12/1997 |
| SU | 1216425 | A | 3/1986 |
| SU | 1429228 | A1 | 10/1988 |
| SU | 1483553 | A1 | 5/1989 |
| WO | WO 01/39353 | A1 | 5/2001 |

OTHER PUBLICATIONS

Advanced Motor Protector; Schlumberger Technology Corporation catalog—"OneCa"t; Dec. 2003.

* cited by examiner

*Primary Examiner*—Anthony D. Stashick
*Assistant Examiner*—Samuel E. Belt
(74) *Attorney, Agent, or Firm*—Van Someren, PC; Bryan P. Galloway; Jaime A. Castano

(57) ABSTRACT

A system and method is provided for reducing the wear on a motor protector, particularly when used in an abrasive environment. The motor protector comprises an outer housing having an internal shaft. The motor protector further comprises a head section having an abrasives exclusion mechanism to reduce the amount of abrasive material contacting a specific component or components within the motor protector.

38 Claims, 5 Drawing Sheets

MOTOR PROTECTOR

CROSS REFERENCE TO RELATED APPLICATIONS

The following is based on and claims priority to Provisional Application Ser. No. 60/503,785, filed Sep. 17, 2003.

BACKGROUND OF INVENTION

In a variety of wellbore environments, electric submersible pumping systems are used to lift fluids from a subterranean location. Although electric submersible pumping systems can utilize a wide variety of components, examples of basic components comprise a submersible pump, a submersible motor and a motor protector. The submersible motor powers the submersible pump, and the motor protector seals the submersible motor from well fluid. The motor protector also balances the internal motor oil pressure with external pressure.

Motor protectors often are designed with a labyrinth system and/or an elastomeric bag system. The labyrinth system uses the difference in specific gravity between the well fluid and internal motor oil to maintain separation between the fluids. The elastomeric bag system relies on an elastomeric bag to physically isolate the motor oil from the well fluid while balancing internal and external pressures. Additionally, motor protectors often have an internal shaft that transmits power from the submersible motor to the submersible pump. The shaft is mounted in journal bearings positioned in the motor protector.

Such protectors function well in many environments. However, in abrasive environments, the runlife of the motor protector can be detrimentally affected. The abrasive sand causes wear in motor protector components, such as the journal bearings. Attempts have been made to increase runlife by populating the motor protector with journal bearings made from extremely hard materials to reduce wear caused by the abrasive sand.

SUMMARY OF INVENTION

In general, the present invention relates to a motor protector for use in an electric submersible pumping system. The motor protector is designed to seal a submersible motor from well fluid and to keep the motor oil pressure generally balanced with external pressure. However, the motor protector also is designed with a sand exclusion mechanism to reduce the effects of sand on protector runlife.

BRIEF DESCRIPTION OF DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for reducing detrimental effects of sand on motor protectors. The system and method are useful with, for example, a variety of downhole production systems, such as electric submersible pumping systems. However, the devices and methods of the present invention are not limited to use in the specific applications that are described herein.

Figure 1:
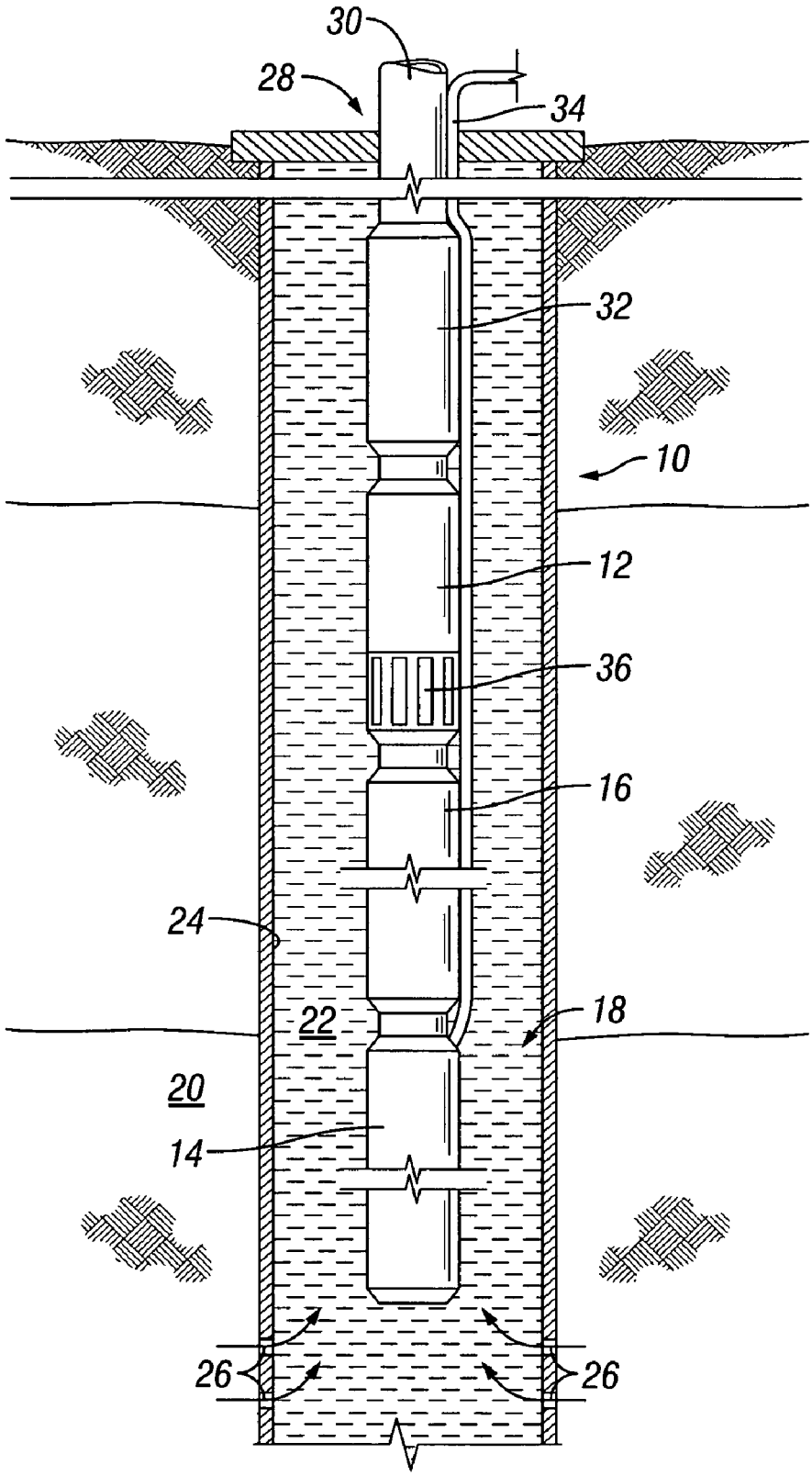
FIG. 1 is a front elevation view of an electric submersible pumping system disclosed in a wellbore, according to an embodiment of the present invention.

Referring generally to FIG. 1, an example of a pumping system 10, such as an electric submersible pumping system, is illustrated according to an embodiment of the present invention. Pumping system 10 may comprise a variety of components depending on the particular application or environment in which it is used. In this example, however, pumping system 10 includes a submersible pump 12, a submersible motor 14 and a motor protector 16.

Pumping system 10 is designed for deployment in a well 18 within a geological formation 20 containing desirable production fluids, such as water or petroleum. A wellbore 22 typically is drilled and lined with a wellbore casing 24. Wellbore casing 24 includes a plurality of openings or perforations 26 through which production fluids flow from formation 20 into wellbore 22.

Pumping system 10 is deployed in wellbore 22 by a deployment system 28 that may have a variety of forms and configurations. For example, deployment system 28 may comprise tubing, such as coil tubing or production tubing, connected to pump 12 by a connector 32. Power is provided to submersible motor 14 via a power cable 34. Motor 14, in turn, powers pump 12 which draws production fluid in through a pump intake 36, and pumps the production fluid to the surface via tubing 30.

It should be noted that the illustrated submersible pumping system 10 is merely an example. Other components can be added to this system and other deployment systems may be implemented. Additionally, the production fluids may be pumped to the surface through tubing 30 or through the annulus formed between deployment system 28 and wellbore casing 24. In any of the many potential configurations of submersible pumping system 10, motor protector 16 is used to seal the submersible motor 14 from well fluid in wellbore 22 and to generally balance the internal pressure within submersible motor 14 with the external pressure in wellbore 22.

Figure 2:
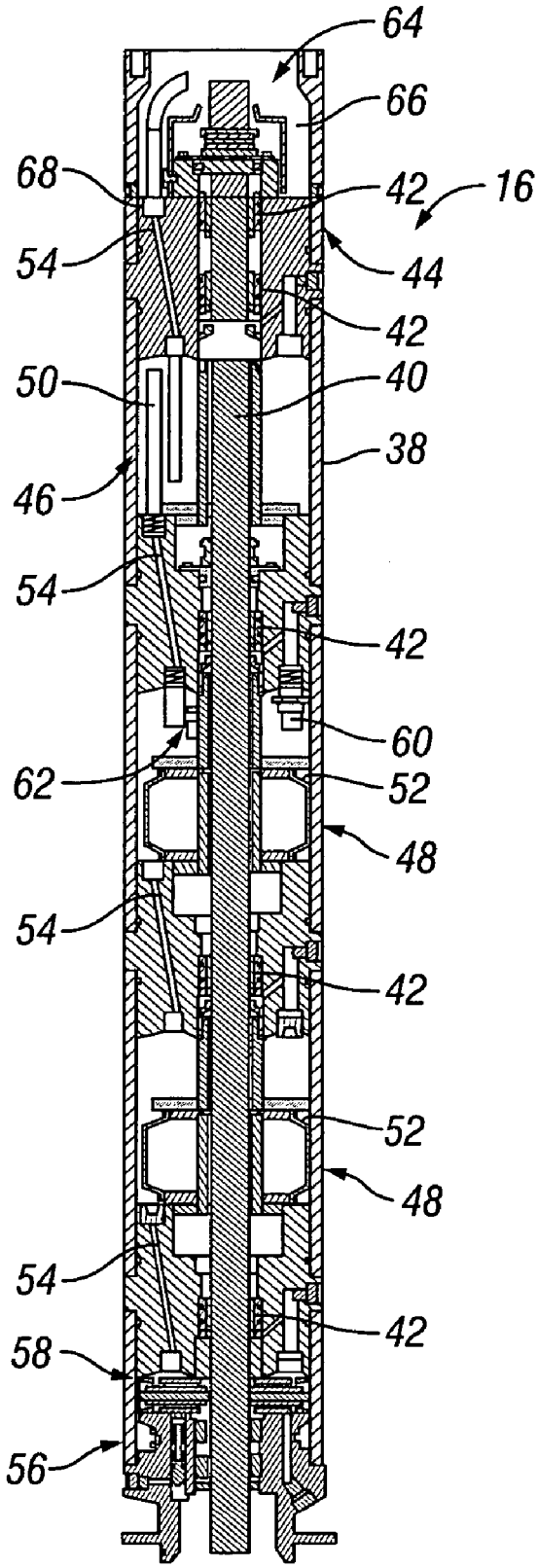
FIG. 2 is a cross-sectional view taken generally along an axis of the motor protector illustrated in FIG. 1, according to an embodiment of the present invention.

Referring generally to FIG. 2, an embodiment of motor protector 16 is illustrated in greater detail. Motor protector 16 comprises an outer housing 38 within which a drive shaft 40 is rotatably mounted via a plurality of bearings 42, such as journal bearings. Outer housing 38 may be formed of one or more housing components. Also, the motor protector 16 is divided into a plurality of sections, including a head section 44 disposed generally at an upper end of the protector. An additional section (or sections) is disposed below head section 44 and functions as a fluid separation section to separate wellbore fluid that may enter head section 44 from internal motor oil used to lubricate submersible motor 14. The sections also facilitate balancing of internal and external pressures. In the embodiment illustrated, a labyrinth section 46 is disposed below head section 44, and a pair of elastomeric bag sections 48 are disposed below labyrinth section 46.

Labyrinth section 46 comprises a labyrinth 50 that uses the difference in specific gravity of the well fluid and the internal motor oil to maintain separation between the internal motor oil and the well fluid. Each bag section uses an elastomeric bag 52 to physically isolate the internal motor oil from the well fluid. It should be noted that the motor protector sections may comprise a variety of section types. For example, the motor protector may comprise one or more labyrinth sections, one or more elastomeric bag sections, combinations of labyrinth and bag sections as well as other separation systems. A series of fluid ports or channels 54 connect each section with the next sequential section. In the embodiment illustrated, a port 54 is disposed between head section 44 and labyrinth section 46, between labyrinth section 46 and the next sequential bag section 48, between bag sections 48 and between the final bag section 48 and a lower end 56 of motor protector 16.

Motor protector 16 may comprise a variety of additional features. For example, a thrust bearing 58 may be deployed proximate lower end 56 to absorb axial loads placed on shaft 40 by the pumping action of submersible pump 12. The protector also may comprise an outward relief mechanism 60, such as an outward relief valve. The outward relief valve releases excessive internal pressure that may build up during, for example, the heating cycle that occurs with startup of electric submersible pumping system 10. Motor protector 16 also may comprise an inward relief mechanism 62, such as an inward relief valve. The inward relief valve relieves excessive negative pressure within the motor protector. For example, a variety of situations, such as system cooldown, can create substantial internal pressure drops, i.e. negative pressure, within the motor protector. Inward relief mechanism 62 alleviates the excessive negative pressure by, for example, releasing external fluid into the motor protector to reduce or avoid mechanical damage to the system caused by this excessive negative pressure.

The motor protector 16 also comprises an abrasives exclusion mechanism 64 to reduce motor protector wear. Abrasives exclusion mechanism 64 is disposed within a head section chamber 66 into which drive shaft 40 extends. Head section chamber 66 is formed within outer housing 38 and is defined at its bottom by a lower end floor or platform 68 of head section 44.

Abrasives exclusion mechanism 64 is designed to limit the effects of abrasives, such as particulates, e.g. sand, scale, debris and various other abrasives that can enter head section chamber 66 with the well fluid. The abrasive quality of such materials can damage the head section, particularly head section components such as seals and head section journal bearings. Abrasives that are able to damage the head section also may gain access to other motor protector components as the sand, or other abrasive material, works its way toward the thrust bearing 58 and submersible motor 14. A damaged head section also may increase the vibration of drive shaft 40 and cause further system damage. It should be noted that abrasives exclusion mechanism 64 also may be designed to limit movement of abrasives into subsequent motor protector sections beneath the head section, as described more fully below.

Figure 3:
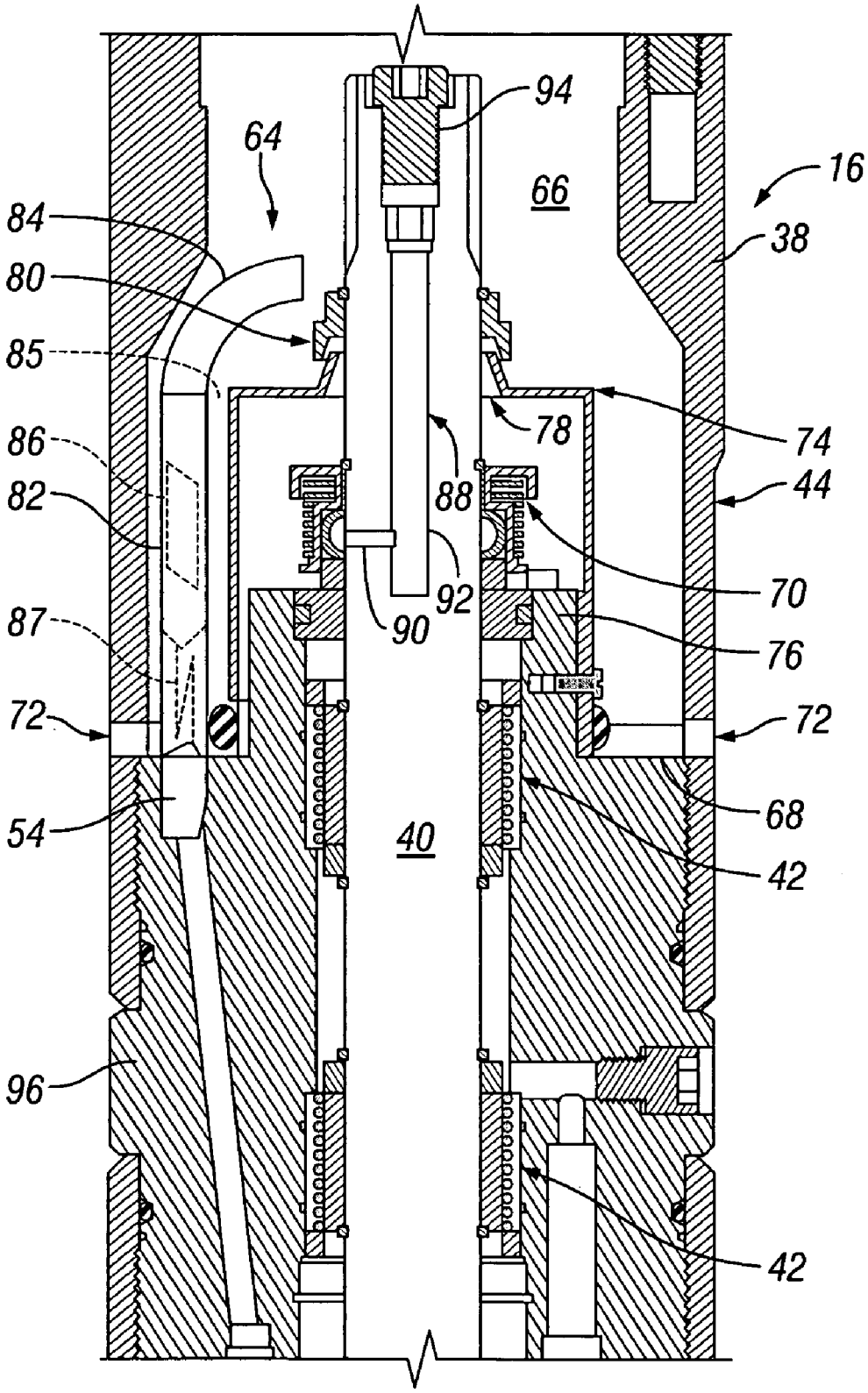
FIG. 3 is an enlarged view of an upper portion of the motor protector illustrated in FIG. 2.

Abrasives exclusion mechanism 64 comprises one or more components or component orientations that limit contact between the abrasive material and susceptible motor protector components, thereby reducing wear and increasing runlife. Referring generally to FIG. 3, a specific embodiment of the exclusion mechanism 64 is illustrated.

As illustrated, mechanism 64 may comprise a raised shaft seal 70 having a raised seal face. Shaft seal 70 is located at an elevated position within head section chamber 66. In other words, shaft seal 70 is raised above the lower end floor 68 so that any abrasives accumulating along floor 68 do not destroy or create excessive wear on shaft seal 70 during operation. Thus, components disposed along shaft 40 remain better protected from abrasives entering head section 44.

Abrasives exclusion mechanism 64 also may comprise one or more drain holes 72 positioned to reduce the possible accumulation of abrasive material in head chamber 44. One or more holes may be formed through outer housing 38 to enable the outflow of, for example, sand from head section chamber 66 to the external environment surrounding motor protector 16. In the embodiment illustrated, a plurality of drain holes 72 are formed generally radially through outer housing 38 proximate a lower end of head section 44. For example, the drain holes may be formed just above the lower end floor 68.

A shroud 74 also may be used to block the movement of sand towards shaft seal 70, upper journal bearing 42 and other components below. Shroud 74 is a stationary shroud positioned over the upper bearing 42 and shaft seal 70. For example, shroud 74 may be mounted to a seal body 76 or other boss within head section chamber 66. Shroud 74 includes an upper opening 78 through which shaft 40 extends. Thus, shroud 74 remains stationary with respect to head section 44 during rotation of shaft 40. Shroud 74 may be made out of metal sheet material or other materials able to provide a barrier that blocks the flow of abrasive particles. Thus, sand, or other abrasives, within head section chamber 66 does not contact shaft seal 70, upper journal bearing 42 or other components disposed below the upper journal bearing 42.

A rotatable shroud 80 may be deployed above stationary shroud 74 to prevent the movement of sand particles through upper opening 78 from a location above shroud 74 and into proximity with shaft seal 70. Rotatable shroud 80 functions as an umbrella-like component to disburse particles away from upper opening 78. In the embodiment illustrated, rotatable shroud 80 is attached to shaft 40 and rotates with the shaft. The rotation of shroud 80 along stationary shroud 74 causes a rotating movement of fluid along the space between the stationary shroud 74 and the rotatable shroud 80. This moving fluid creates a centrifuge effect that further limits contact between abrasive particles and shaft seal 70 or journal bearing 42. Alternatively, a seal may be created between shroud 74 and shroud 80. Furthermore, a variety of materials can be used to construct shroud 80, and the component may be attached to shaft 40 by a variety of mechanisms, including snap rings, collars, fasteners, etc.

As discussed above, a port 54 enables communication of fluid between head section chamber 66 and the next adjacent fluid separation section, such as labyrinth section 46. To prevent the flow of abrasives from head section chamber 66 into successive sections, exclusion mechanism 64 also may comprise a stand tube 82 connected to the port 54 and extending upwardly into head section chamber 66. Thus, any particulates accumulating along lower end floor 68 are not allowed to fall through port 54 into adjacent motor protector sections. Further precautions may be taken against abrasives entering port 54 by bending the stand tube 82 or providing the stand tube with a bent section 84. Alternatively or additionally, stand tube 82 may be provided with a cap 85 (shown in dashed lines), a filter 86 (shown in dashed lines), a tortuous path 87 (shown in dashed lines) or other sand blocking mechanisms.

Motor protector 16 also may comprise a vent passageway 88 for venting air from head section chamber 66 during, for example, oil-filling procedures. As motor oil is poured into motor protector 16 and submersible motor 14, escaping air is vented through passageway 88. In the embodiment illustrated, vent passageway 88 is disposed through shaft 40. For example, passageway 88 may comprise a radial passage 90 extending from a radial exterior of the shaft to an axial passageway 92. Axial passageway 92 routes escaping air upwardly through shaft 40 and through an outlet or valve 94 disposed at the top end of shaft 40.

Figure 4:
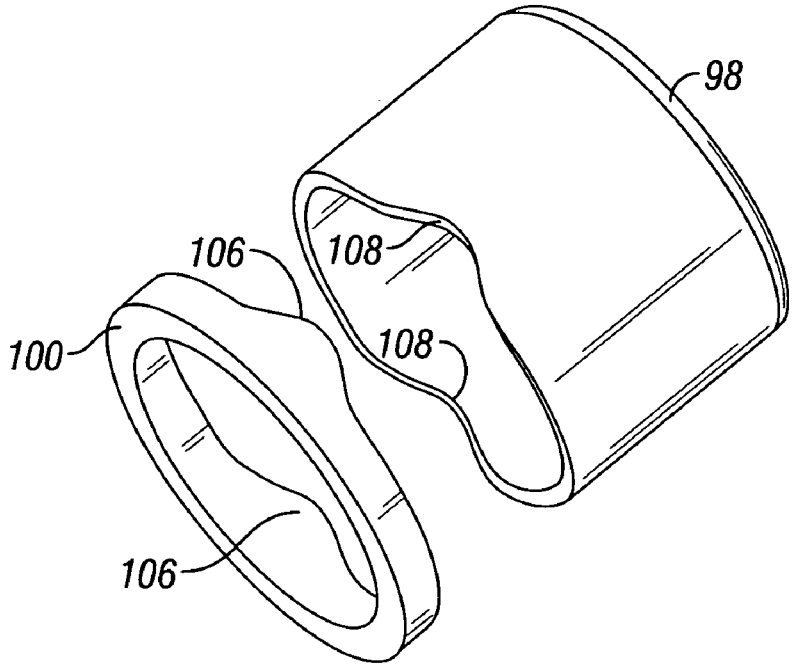
FIG. 4 is an orthogonal view of a bearing and lock ring embodiment that can be used with the motor protector illustrated in FIGS. 2 and 3.
Figure 5:
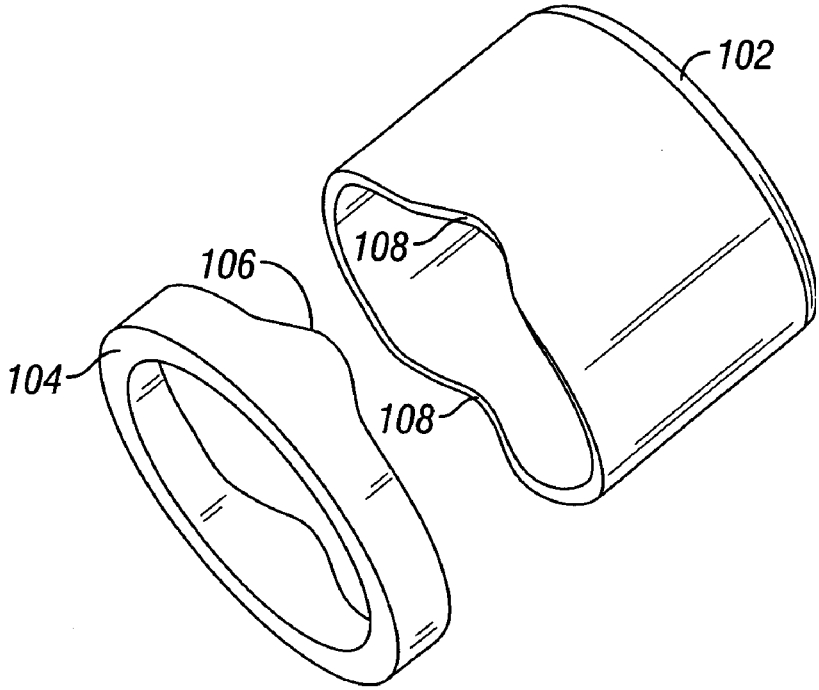
FIG. 5 is an orthogonal view of a sleeve and lock ring embodiment that can be used with the motor protector illustrated in FIGS. 2 and 3.

Referring generally to FIGS. 4 and 5, one or more journal bearings 42 may be formed as keyless journal bearings. For example, the upper two journal bearings, illustrated in FIG. 3, may be formed as keyless bearings. The keyless journal bearings are able to substantially reduce the stress concentration otherwise caused by conventional key ways or notches. In the embodiment illustrated in FIG. 3, at least two keyless journal bearings 42 are used in a top seal body 96 to improve the system stability. The use of two or more bearings in a single body renders the overall system more robust and reduces tolerance stacking.

In FIG. 4, an example of a bearing portion 98 and a lock ring 100 are illustrated. Similarly, in FIG. 5, an example of a sleeve 102 and lock ring 104 are illustrated. In both cases, the lock rings 100, 104 create a mating "wavy" interface with the corresponding bearing portion 98 and sleeve 102 for load transfer. In this example, each lock ring comprises one or more protuberances 106 that engage corresponding recesses 108 on the bearing and sleeve, respectively. The bearing components may be made from hard materials, such as ceramic, carbide or cermet materials. This keyless design greatly reduces stress concentrations which, in turn, helps reduce cracking or other wear on the bearing and/or sleeve.

Figure 6:
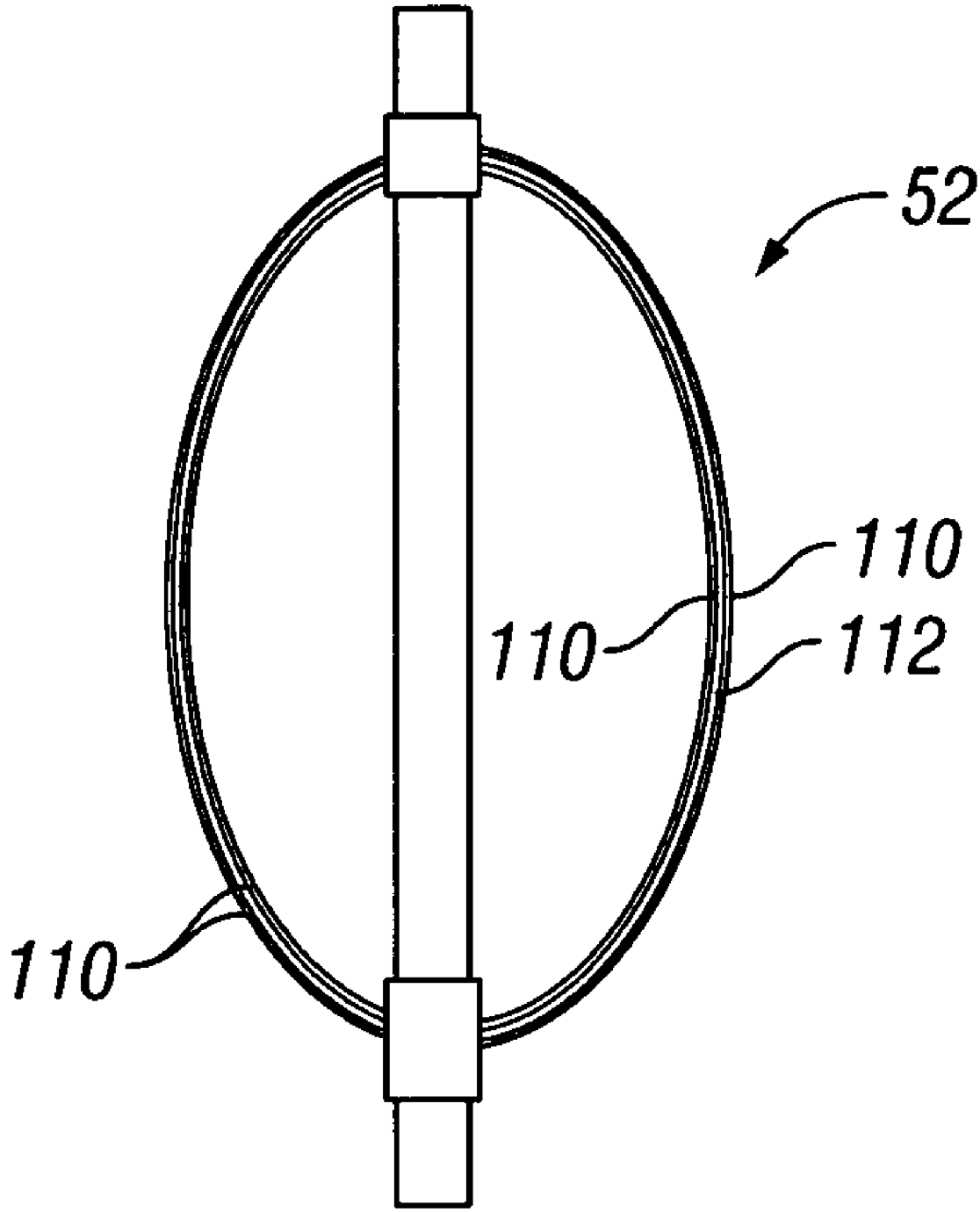
FIG. 6 is a schematic illustration of an elastomeric bag that can be used with the motor protector illustrated in FIGS. 2 and 3.

Motor protector 16 also may utilize reinforced bags, as illustrated in FIG. 6, in bag sections 48. The reinforced bags can be useful in, for example, high temperature applications. In one embodiment, each bag 52 comprises a polymer layer 110 and a reinforced layer 112, such as a perfluoroelastomer or fiber-reinforced layer. In the example illustrated, reinforced layer 112 comprises a fiber layer that is disposed between polymer layers 110. This multi-layer, composite approach provides a strong bag 52 able to withstand high temperatures or other adverse conditions.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

The invention claimed is:

1. A system for use in an electric submersible pumping system, comprising:

a motor protector having an outer housing, an internal shaft, a fluid separation section and a head section, the head section having an abrasives exclusion mechanism to reduce motor protector wear, the abrasives exclusion mechanism comprising a shaft seal raised above a floor of the head section by a seal body, a stationary shroud mounted to the seal body and extending above the shaft seal, and a rotatable shroud deployed above the stationary shroud and secured to the internal shaft.

2. The system as recited in claim 1, wherein the abrasives exclusion mechanism comprises a drainage hole disposed through the outer housing at a lower end of the head section.

3. The system as recited in claim 1, wherein the head section comprises a fluid port disposed through a lower end floor of the head section, and the abrasives exclusion mechanism comprises a stand tube extending upwardly from the fluid port.

4. The system as recited in claim 3, wherein the stand tube comprises a barrier that prevents the entry of abrasives into the stand tube.

5. The system as recited in claim 1, wherein the internal shaft comprises an internal air vent passageway.

6. The system as recited in claim 1, wherein the internal shaft is supported by at least one keyless journal bearing.

7. The system as recited in claim 1, wherein the motor protector further comprises a valve, the valve being inwardly oriented to relieve excessive negative pressure within the motor protector.

8. The system as recited in claim 1, wherein the motor protector further comprises a bag section, the bag section having a fiber-reinforced polymer bag.

9. A pumping system, comprising:

a submersible pump;

a submersible motor to power the submersible pump; and a motor protector fluidically coupled to the submersible motor, the motor protector having a head section with a head section keyless journal bearing and an abrasives exclusion mechanism to reduce the amount of abrasive material contacting the head section bearing.

10. The system as recited in claim 9, wherein the motor protector is disposed between the submersible pump and the submersible motor.

11. The system as recited in claim 9, wherein the head section comprises an internal chamber into which a drive shaft extends.

12. The system as recited in claim 11, wherein the abrasives exclusion mechanism comprises a shaft seal located about the drive shaft at an elevated position within the internal chamber.

13. The system as recited in claim 11, wherein the abrasives exclusion mechanism comprises a drainage hole disposed through the outer housing at a lower end of the head section.

14. The system as recited in claim 11, wherein the motor protector further comprises a labyrinth section and a bag section.

15. The system as recited in claim 14, wherein the bag section has a fiber-reinforced polymer bag.

16. The system as recited in claim 11, wherein the head section comprises a fluid port that extends to a lower motor protector section, the fluid port being coupled to a stand tube extending into the internal chamber.

17. The system as recited in claim 9, wherein the abrasives exclusion mechanism comprises a shroud disposed over the shaft seal.

18. The system as recited in claim 9, wherein the motor protector further comprises a valve, the valve being inwardly oriented to relieve excessive negative pressure within the motor protector.

19. A method of improving the performance of a motor protector used in abrasive conditions, comprising:

rotatably mounting a shaft through a bearing and a shaft seal positioned within a motor protector housing;

providing a head section into which an upper end of the shaft extends;

protecting the bearing and the shaft seal from contact with sand entering the head section;

placing a fluid port through a lower portion of the head section to provide fluid communication between a head section chamber and a lower motor protector section;

locating a stand tube in the head section chamber and coupling the stand tube to the fluid port; and bending the stand tube.

20. The method as recited in claim 19, wherein rotatably mounting comprises mounting the shaft in a pair of keyless bearings.

21. The method as recited in claim 19, wherein protecting comprises mounting the shaft seal at an elevated position above the lower portion.

22. The method as recited in claim 19, wherein protecting comprises locating a stationary shroud within the head section chamber above the bearing.

23. The method as recited in claim 22, wherein protecting further comprises attaching a rotatable shroud to the shaft proximate the stationary shroud to create a centrifuge effect during operation.

24. The method as recited in claim 19, wherein protecting comprises forming at least one hole through the motor protector housing proximate the lower portion to provide a passageway for dispelling abrasives from the head section chamber.

25. The method as recited in claim 19, further comprising placing a filter in the stand tube.

26. The method as recited in claim 19, further comprising creating a tortuous path along the stand tube.

27. The method as recited in claim 19, further comprising placing a cap above the stand tube.

28. The method as recited in claim 19, further comprising venting a gas through the shaft.

29. The method as recited in claim 19, further comprising positioning a relief valve to relieve excessive negative pressure within the motor protector.

30. A pumping system, comprising:

a submersible pump;

a submersible motor to power the submersible pump; and a motor protector fluidically coupled to the submersible motor, the motor protector having a head section with a shaft seal and an abrasives exclusion mechanism to reduce the amount of abrasive material contacting the shaft seal, the abrasives exclusion mechanism comprising a stationary shroud extending above the shaft seal, and a rotatable shroud deployed above the stationary shroud and adjacent the stationary shroud, the rotatable shroud being secured to an internal shaft.

31. The system as recited in claim 30, wherein the abrasives exclusion mechanism comprises a head section journal bearing protected by the abrasives exclusion mechanism.

32. The system as recited in claim 30, wherein the abrasives exclusion mechanism comprises a drainage hole disposed through the outer housing at a lower end of the head section.

33. The system as recited in claim 30, wherein the head section comprises a fluid port that extends to a lower motor protector section, the fluid port being coupled to a stand tube extending into the internal chamber.

34. The system as recited in claim 30, wherein the motor protector further comprises a valve, the valve being inwardly oriented to relieve excessive negative pressure within the motor protector.

35. A system for improving the performance of a motor protector used in abrasive conditions, comprising:

means for rotatably mounting a shaft in a bearing positioned within a motor protector housing;

means for providing a head section chamber and into which a shaft extends; and means for protecting the bearing by which the shaft is rotatably supported, the means for protecting comprising a shaft seal raised above a floor of the head section chamber and at least one drain hole formed through an outer housing of the motor protector proximate the floor of the head section chamber.

36. The system as recited in claim 35, wherein the means for rotatably mounting comprises a keyless journal bearing.

37. The system as recited in claim 35, wherein the means for providing comprises a head section formed within an outer motor protector housing.

38. The system as recited in claim 35, wherein the means for protecting comprises a sand diverter mechanism to prevent sand from contacting the bearing.

* * * * *